US005349507A

United States Patent [19]

Parker

[11] Patent Number: 5,349,507

[45] Date of Patent: Sep. 20, 1994

[54] FLASHLIGHT WITH PRESSURE RELIEF VALVE

[76] Inventor: David H. Parker, 2255 Jefferson St., Torrance, Calif. 90501

[21] Appl. No.: 164,556

[22] Filed: Dec. 10, 1993

[51] Int. Cl.[5] ..... F21L 7/00
[52] U.S. Cl. ..... 362/158; 362/267
[58] Field of Search ..... 362/158, 267, 294

[56] References Cited

U.S. PATENT DOCUMENTS 4,237,526 12/1980 Wood ..... 362/158
5,113,326 5/1992 Maglica ..... 362/158

*Primary Examiner*—Stephen F. Husar
*Attorney, Agent, or Firm*—Matthew P. Lynch

[57] ABSTRACT

Including of a pressure relief valve assembly in conjunction with the body of a watertight/airtight flashlight. The pressure relief valve is to function to dissipate a pressurized hydrogen gas within the body of the flashlight and expel such into the ambient. The hydrogen gas is created by normal operation of the flashlight.

2 Claims, 1 Drawing Sheet

FLASHLIGHT WITH PRESSURE RELIEF VALVE

BACKGROUND OF THE INVENTION

1) Field of the Invention

The field of this invention relates to hand-held flashlights and more particularly to a flashlight which is sealed from the ambient in both a watertight and airtight manner.

2) Description of Prior Art

It has long been known that battery operated flashlights may create hydrogen gas during their operation. In most flashlights, the battery compartment is not sealed and therefore the hydrogen gas dissipates into the ambient and poses no hazard. It is well known that hydrogen gas is exceedingly explosive. It only takes a small amount of such gas and a slight spark to cause an explosion.

Some flashlights have battery compartments which are sealed and are intended to not only be airtight but also watertight so that the flashlights can be used under water. In these types of flashlights, the hydrogen gas that is generated cannot escape into the ambient. There are instances where the user of such a flashlight will grasp the flashlight, turn it on, and the flashlight will explode in the operator's hand. Such an explosion can cause injury to the operator.

It is desirable to include some type of device in conjunction with such a flashlight to insure that any hydrogen gas that may be generated by the batteries be either removed or rendered harmless. Within the prior art there has been incorporated a hydrogen absorbing pellet within the interior compartment of the flashlight. It is the function of that pellet to absorb any created hydrogen gas and thereby eliminate the hazard. However, the new flashlights have more powerful batteries. If a user abuses the flashlight by reversing polarity of the batteries or by mixing old and new batteries, these batteries have a much greater energy bleed-off. This means that there is more heat, more hydrogen gas, and therefore raised levels of internal pressure within the body of the flashlight. There is a possibility that the quantity of gas that is created within the internal compartment of the flashlight is too great to be absorbed by the pellet. Also the gas may be created so rapidly that complete absorption is not possible by the pellet.

SUMMARY OF THE INVENTION

The primary objective of the present invention is to construct a hand-held type of sealed flashlight which includes a pressure relief valve which permits the flashlight to be used in all environments, including underwater, eliminating any hazard to the user of the flashlight exploding due to the creating of hydrogen gas.

Another objective of the present invention is to incorporate a safety device in conjunction with a flashlight to preclude the possibility of the flashlight exploding during normal usage.

Another objective of the present invention is to construct a valve assembly in conjunction with the body of the hand-held flashlight which can be constructed inexpensively and therefore not significantly increase the overall cost of the flashlight to the ultimate consumer.

Typical hand-held flashlights have a battery compartment within which is located batteries with the batteries to connect with the reflector housing which is mounted within the access opening to the battery compartment. Within the reflector housing is mounted a light bulb. A lens cover surrounds the reflector housing and is removably engaged in a fluid tight manner to the body of the flashlight. The internal battery compartment of the flashlight is completely sealed to the ambient in a watertight and airtight manner. Mounted within the sidewall of the body of the flashlight is a pressure relief opening. A pressure relief valve assembly is mounted in conjunction with that opening with this pressure relief valve assembly being continuously biased toward a closed position which closes the opening and would prevent expellance of gas from the internal compartment of the flashlight. Upon sufficient pressure of a pre-selected amount of gas being obtained within the internal compartment, the valve assembly opens which causes the gas to be expelled into the ambient. Upon the pressure of the gas being relieved within the internal compartment, the valve assembly will automatically close.

DETAILED DESCRIPTION OF THE SHOWN EMBODIMENT

Figure 1:
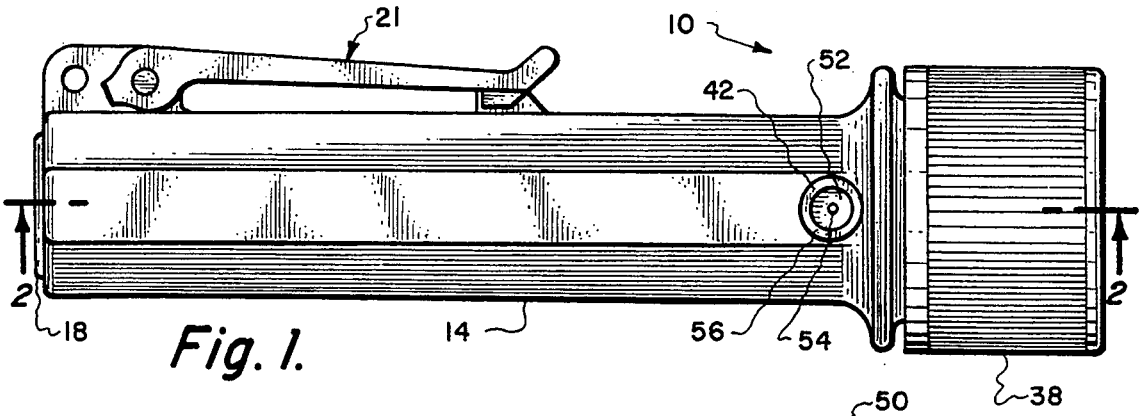
FIG. 1 is a side elevational view of a hand-held flashlight within which has been incorporated the relief valve of the present invention.
Figure 2:
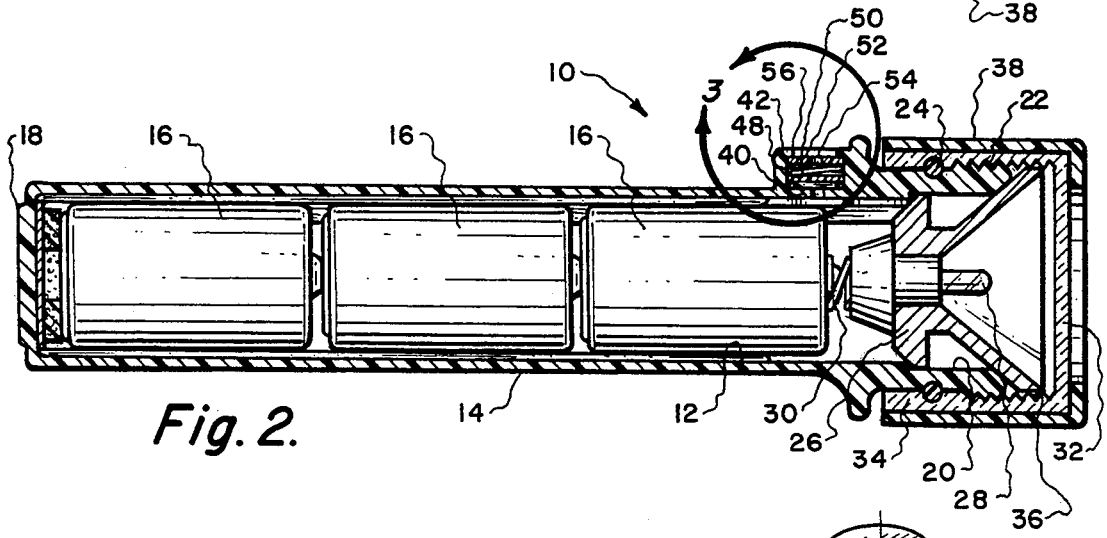
FIG. 2 is a longitudinal cross-sectional view through the hand-held flashlight of the present invention taken along line 2—2 of FIG. 1.

Referring in particular to the drawing, there is shown a conventional hand-held flashlight 10 which has an elongated body 14 within which is formed an internal battery receiving compartment 12. Shown within the compartment 12 are a plurality of batteries 16 which are located in an in-line arrangement. Body 14 is basically tubular and is closed at the back end 18 and open at the front end forming access opening 20. Mounted on the exterior surface of the body 14 is an attaching clip assembly 21. It is the function of the attaching clip assembly 21 to facilitate connection to an outside structure such as the user's clothing.

The portion of the body 14 exteriorly of the access opening 20 includes a series of screw threads 22. Mounted within an appropriate groove directly adjacent the screw threads 22 and on the body 14 is an O-ring seal 24. Mounted within the access opening 20 is a reflector housing 26. Centrally mounted within the reflector housing 26 is a light bulb 28. Light bulb 28 electrically connects through coil spring 30 to the forward most battery of the batteries 16.

Located exteriorly of the reflector housing 26 is a transparent lens cover 32. This transparent lens cover has a sidewall 34 which includes a series of screw threads 36. Exteriorly mounted on the lens cover 32 and the sidewall 34 in a close fitting fixed manner is a cap 38.

The cap 38 is to be connected to the body 14 so that the threads 36 and 22 engage. An airtight/watertight seal is established between the sidewall 34 and the body 14 by means of an O-ring seal 24. The O-ring seal 24 will normally be constructed of a rubber or other similar resilient material.

Mounted within the sidewall 14 is a pressure relief opening 40. The body 14 includes a valve housing 42 located at the hole 40. The valve housing 42 includes an internal chamber 44. Within this chamber 44 there is located an O-ring seal 46 which is to abut against the portion of the body 14 surrounding the hole 40. A sealing disc 48 is located within the chamber 44 and against the O-ring seal 46. The coil spring 50 abuts against the sealing disc 48 with the outer end of the coil spring 50 being closed by a cap disc 52. The cap disc 52 includes a center hole 54.

Figure 3:
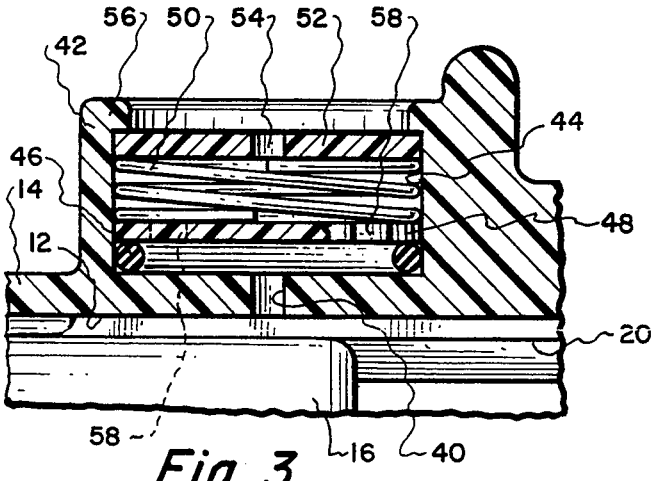
FIG. 3 is an enlarged cross-sectional view of the pressure relief valve assembly incorporated within the flashlight of the present invention showing the position of the pressure relief valve in the closed position.
Figure 4:
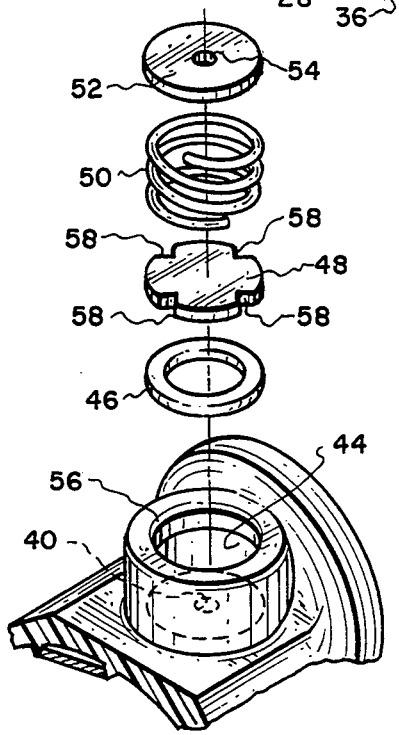
FIG. 4 is an exploded isometric view of the pressure relief valve assembly of FIG. 3.

The housing 42 includes an inwardly extending annular flange 56 which holds the cap disc 52 within the chamber 44 with the coil spring 50 being compressed a predetermined amount. A certain amount of pressure must be conducted through the hole 40 in contact with the sealing plate 48 so as to unseat the plate 48 same from its normally closed position shown in FIG. 3. The force of the coil spring 50 is so that the pressurized gas will vent at approximately two and one-half pounds per square inch relative to the ambient pressure. When this unseating occurs, pressurized gas is able to flow through hole 40, past the O-ring seal 46 and through the grooves 58 formed within the periphery of the sealing disc 48. There are four in number of the grooves 58. However, this number of grooves can be increased or decreased without departing from the scope of this invention. The gas that is being expelled from the internal compartment 12 is passed through the grooves 58 into the internal chamber 44 and through the hole 54 into the ambient. Upon the pressure of the gas within the compartment 12 being lowered to a predetermined amount determined by the force of the coil spring 50, the coil spring 50 will cause the sealing plate 48 to again be moved to the closed position as shown in FIG. 3, thereby preventing any further expelling of gas from the pressure relief opening 40 into the ambient. In actual practice the sealing disc 48 will only be moved a minute amount away from the O-ring seal 46 in order to permit the gas to flow through the grooves 58. The force of the coil spring 50 is so that the pressurized gas will vent at approximately two and one-half pounds per square inch relative to the ambient pressure.

What is claimed is:

1. In combination with the flashlight formed of a body having an enclosed internal compartment, said compartment being substantially airtight and watertight, said compartment adapted to contain at least one battery, said compartment having an access opening, a reflector housing mounted within said access opening, a light bulb mounted within said reflector housing, a lens cover enclosing said reflector housing and sealing in a fluid-tight manner with said body, the improvement comprising:

a pressure relief opening formed within said body, a pressure relief valve assembly mounted on said body in conjunction with said pressure relief opening, said pressure relief valve assembly to expel into the ambient pressurized gas accumulated within said internal compartment;

said pressure relief valve assembly being normally closed, said pressure relief valve assembly opens automatically upon sufficient gas pressure being accumulated within said internal compartment; and said pressure relief valve assembly including a spring, said spring pressing against a sealing disc, said spring normally locating said sealing disc in the closed position closing said pressure relief opening, said sealing disc having a peripheral edge, said peripheral edge including at least one groove, whereby upon sufficient gas pressure being created within said internal compartment said sealing disc is unseated from its said seated position with gas being permitted to flow through said groove into the ambient.

2. The combination as defined in claim 1 wherein: said spring means comprising a coil spring.

* * * * *